US010308494B2

(12) United States Patent
Landman et al.

(10) Patent No.: US 10,308,494 B2
(45) **Date of Patent: *Jun. 4, 2019**

(54) BEVERAGE DISPENSING ASSEMBLY AND TAP

(71) Applicant: HEINEKEN SUPPLY CHAIN B.V., Amsterdam (NL)

(72) Inventors: Bernardus Cornelis Johannes Landman, Amsterdam (NL); Jeroen Frank Otto, Amsterdam (NL); Rudolf Klaas Van Beelen, Amsterdam (NL); Vincent Schats, Amsterdam (NL)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/116,094

(22) PCT Filed: Feb. 3, 2015

(86) PCT No.: PCT/NL2015/050074
§ 371 (c)(1),
(2) Date: Aug. 2, 2016

(87) PCT Pub. No.: WO2015/147636
PCT Pub. Date: Oct. 1, 2015

(65) Prior Publication Data

US 2017/0174494 A1 Jun. 22, 2017

(30) Foreign Application Priority Data

Feb. 4, 2014 (NL) ..... 2012200

(51) Int. Cl.

| | |
|---|---|
| ***B67D 1/00*** | (2006.01) |
| ***B67D 1/04*** | (2006.01) |
| ***B67D 1/08*** | (2006.01) |
| ***B67D 1/12*** | (2006.01) |
| ***B67D 1/14*** | (2006.01) |

(52) U.S. Cl.
CPC ..... *B67D 1/0412* (2013.01); *B67D 1/0082* (2013.01); *B67D 1/0406* (2013.01);
(Continued)

(58) Field of Classification Search
CPC ..... B67D 1/0412; B67D 1/0082
(Continued)

(56) References Cited

U.S. PATENT DOCUMENTS 2,035,202 A * 3/1936 Smith ..... B67D 3/043 239/583
2,236,620 A 4/1941 Cornelius
(Continued)

FOREIGN PATENT DOCUMENTS

AU 544 609 B2 6/1985
DE 35 141 72 A1 10/1986
(Continued)

OTHER PUBLICATIONS

Michael F. Ashby & David R. H. Jones, Engineering Materials I: An Introduction to Properties, Applications, and Design, Chapter 3, p. 34 (4th ed. 2012).

*Primary Examiner* — Jeremy Carroll
(74) *Attorney, Agent, or Firm* — Pearne & Gordon LLP

(57) ABSTRACT

Dispensing assembly (10) comprising a container (1), containing a pressurized beverage, connected to or provided with a dispense assembly, wherein the dispense assembly comprises an outlet channel (12) closable by a valve body (16) and a chamber (14) between the container (1) and the valve body (16), which chamber (14) is at least partly closed by a movable and/or deformable wall part (28) connected to the valve body (16) or a valve seat, such that pressurized beverage from the container filling the chamber forces the wall part (28), into a position biasing the valve body (16) or the valve seat in a position closing the outlet channel (12)
(Continued)

Figure 1:
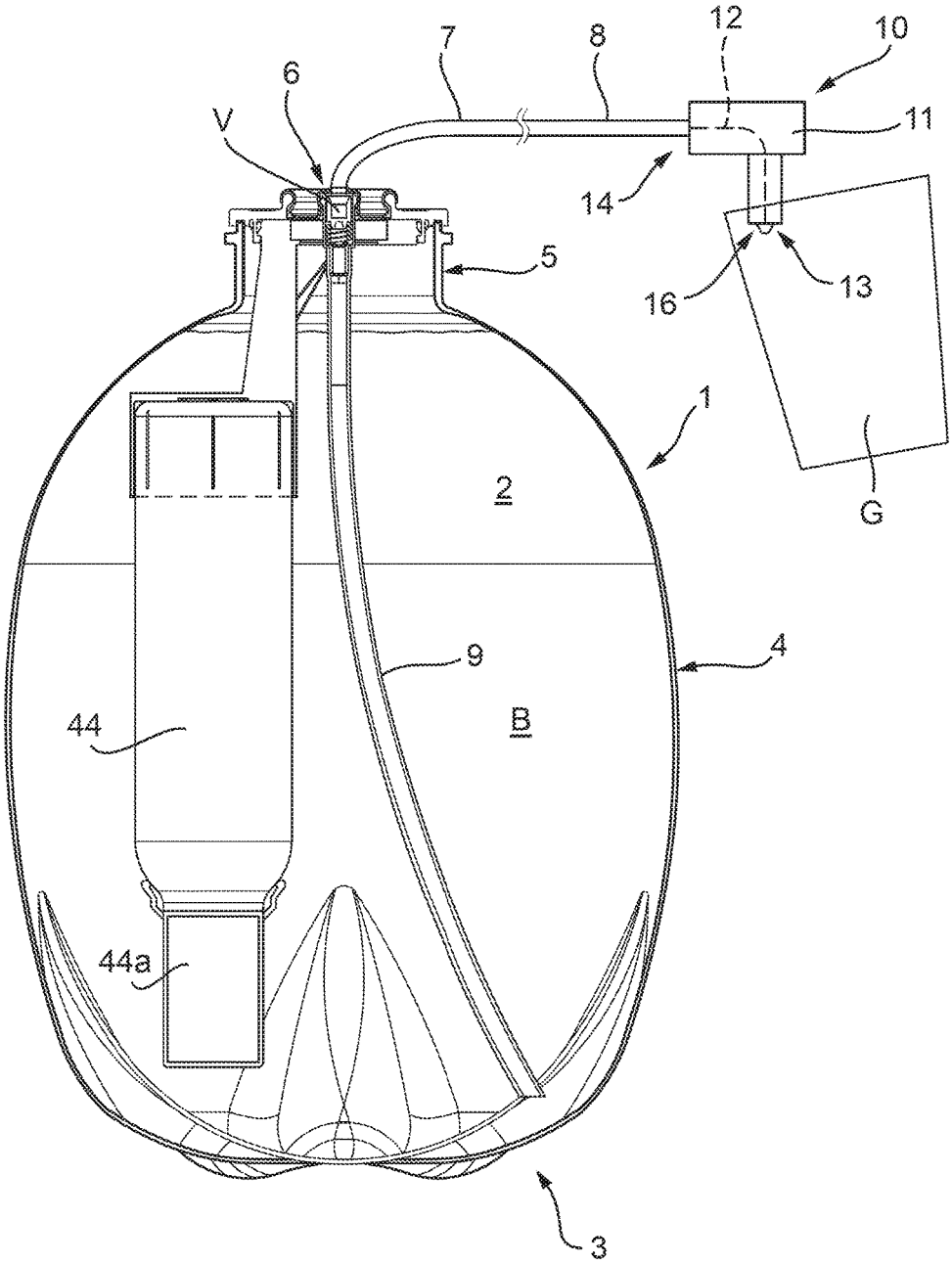

and by pushing the wall part the valve body (16) or the valve seat can be forced into a position opening the outlet channel (12), wherein preferably at least during use there is an open connection between said chamber (14) and a beverage compartment of the container (1).

38 Claims, 14 Drawing Sheets

(52) U.S. Cl.
CPC ..... *B67D 1/0802* (2013.01); *B67D 1/1256* (2013.01); *B67D 1/1405* (2013.01); *B67D 1/1477* (2013.01); *B67D 2001/0098* (2013.01); *B67D 2001/0828* (2013.01)

(58) Field of Classification Search
USPC ..... 222/399
See application file for complete search history.

(56) References Cited

U.S. PATENT DOCUMENTS

| | | | | |
|---|---|---|---|---|
| 3,168,967 | A | 2/1965 | Giampa | |
| 4,773,571 | A | 9/1988 | Hagan et al. | |
| 5,228,604 | A | 7/1993 | Lanini et al. | |
| 5,862,996 | A | 1/1999 | Crichton | |
| 5,878,992 | A * | 3/1999 | Edwards | B67C 3/26 251/122 |
| 6,729,507 | B2 * | 5/2004 | Nagahata | B67C 3/281 222/108 |
| 7,040,359 | B2 * | 5/2006 | Younkle | B05B 1/265 141/255 |
| 2011/0036807 | A1 | 2/2011 | Landman | |
| 2011/0038989 | A1 * | 2/2011 | Landman | B67D 1/0801 426/115 |

FOREIGN PATENT DOCUMENTS

| | | | |
|---|---|---|---|
| EP | 0 480 346 | A2 | 4/1992 |
| EP | 0 861 801 | A1 | 9/1998 |
| EP | 1 506 129 | | 12/2003 |
| FR | 2 610 305 | A1 | 8/1988 |
| GB | 1 477 476 | A | 6/1977 |
| NL | 1 012 802 | C2 | 6/2000 |
| WO | 98/30490 | A1 | 7/1998 |
| WO | 03/101882 | A1 | 12/2003 |
| WO | 2009/126034 | A1 | 10/2009 |

* cited by examiner

BEVERAGE DISPENSING ASSEMBLY AND TAP

The invention relates to a dispensing assembly for beverage. The invention especially relates to a dispensing assembly for use with a container comprising a beverage, such as a carbonated beverage, with a tap.

It is well known to provide beverages in containers for dispensing, for example at home or at events, such as at a picnic, or in small outlets, which containers are self dispensing, which means that the beverage is for example pressurized inside the container by an internal or container mounted pressurizer, such as a gas cartridge, or is dispensed by gravity. The containers are generally of a size such that they can be cooled inside a refrigerator, and contain for example a few liters of beverage. Such container is for example known from NL1012802, containing carbonated beverage, such as beer, and is provided with an internal pressurizing device. Another example of such container is known from U.S. Pat. No. 4,773,571, disclosing a bottle containing gas-pressurized water. Other dispensing system comprise a pressure source external to the container, such as for example a CO2 cartridge, connected to the container by a pressure regulator.

These known containers comprise or are connected to a valve for dispensing the beverage from the container, with a spout connected to the valve, such that the beverage can be guided to a glass or such holder. Pressure of the beverage may lead to leaking of the tap. A spout can have the disadvantage that beverage may be trapped inside the spout when the valve is closed after dispensing. This beverage may later drip out, spilling for example inside a refrigerator or on a table top or the like. In fixed tapping devices such as in bars this dripping beverage can be collected in a drip tray. For non fixed containers, such as the self dispensing containers, such dip tray is not a suitable solution.

EP1506129 discloses a container similar to the container known from NL1012802, in which this dripping problem has been addressed by providing an air inlet opening close to the valve, that is spaced apart from the outlet end of the spout, which opening is closed when dispensing and open when the valve is closed, for letting air into the spout, behind the beverage inside the spout and thus equalizing pressure, allowing the beverage to flow out directly from the spout. A similar but more complicated solution is proposed in DE3514172.

GB1477476 discloses a dispensing tap in which the tap has a spout which extends substantially vertical during use, wherein the beverage valve mechanism of the tap is provided in the spout, defining a twisting beverage channel, and a complicated second valve mechanism is provided at the upper end of the spout, which again opens an air channel when the beverage valve is closed, and which is closed when the beverage valve mechanism is pulled up for opening the beverage channel.

Another problem with the known dispensing assemblies is that they may not always have an optimal flow pattern. Especially the jet when leaving the outlet or dispensing opening, such as the end of the spout may not be straight and well defined and can lead to for example splattering, drops of the beverage being dispensed having directions different from the predominant direction of the jet.

A further problem with the known valve systems is the complexity, and especially the necessity of using springs, especially metal springs, for biasing the valves in either an open or a closed position, or both.

A still further problem of these known dispensing systems may be that the tap will leak due to beverage pressure acting on a valve or valve body of the tap.

An aim of the present disclosure is to provide for an alternative dispensing assembly and/or a container provided with such alternative assembly. An aim of the present disclosure is to provide an alternative solution to the leaking and/or dripping problem as discussed. An aim of the present disclosure is to provide a dispensing assembly and/or a container comprising such assembly, limiting or preventing leaking and/or dripping of beverage from the assembly during or after a prolonged period of time. An aim of the present disclosure is to provide for a dispensing assembly and/or a container comprising such assembly, preventing undesired leaking and/or dripping and which is easy of construction and use. An aim of the present invention is to provide an alternative dispensing assembly and/or container providing a proper, relatively concentrated jet of beverage.

One or more of these and other aims is obtained at least in part by a dispense assembly and/or container according to this disclosure.

In an aspect a dispensing assembly according to this disclosure can comprise a container, containing a pressurized beverage, and connected to or provided with a dispense assembly. The dispense assembly comprises an outlet channel closable by a valve body and a chamber between the container and the valve body, which chamber is at least partly closed by a movable and/or deformable wall part connected to the valve body or a valve seat. Pressurized beverage from the container filling the chamber can force the wall part into a position biasing the valve body or the valve seat in a position closing the outlet channel. By pushing the wall part the valve body or the valve seat can be forced into a position opening the outlet channel. Preferably at least during use there is an open connection between said chamber and a beverage compartment of the container. In this aspect either the valve body or the valve seat can be movable relative to the outlet channel, or both.

A dispensing assembly for beverage from a container according to the disclosure can comprise an outlet channel for beverage and a valve body operable to open and close said outlet channel. The channel defines a direction of flow of the beverage towards an outlet end. The valve body can be provided at or near the outlet end of the outlet channel and can have substantially a bullet shape with a base facing in a direction against the direction of flow and a tip with an end facing in the direction of flow. The tip, between the base and the end, can have an outwardly curved outer surface, such that beverage engaging the base can be guided from the base over the outer surface to the end forming a beverage jet when leaving the surface at or near said end.

In an aspect of the present disclosure the valve body is movable relative to a valve seat, between a closed position in which the valve body rests against the seat and an open position in which the valve body is spaced apart from the seat, wherein the valve body extends substantially outside the outlet channel, at least in the open position.

In another aspect in a dispense assembly in said outlet channel a chamber can be provided, at least partly closed by a movable and/or deformable wall part, such as a flexible membrane, connected to a stem connected to a valve body and/or valve seat closing off the outlet channel at or near a down stream outlet end. The chamber can be in fluid connection with pressurized beverage in a compartment of a container to which the assembly is connected or of which it forms a part. If a deformable wall is used it can be resilient, such that it biases the valve body and/or valve seat in a closed position. The beverage can pressurize the membrane such that it biases the valve body and/or valve seat in a closed position. For example the beverage can pressurize the membrane by maximizing the internal volume of the chamber, pulling or pushing the valve body onto a seat or vice versa closing the outlet channel. By pressuring the membrane from an opposite side, for example from outside the chamber, for example manually or by a lever or such artifact, the membrane can be deformed such that the valve body and/or seat are moved to a position in which the outlet channel is open. Similarly the valve seat could be movable by said wall part, especially said membrane and the stem.

In another aspect a container according to the disclosure can contain a pressurized beverage, connected to or provided with a dispense assembly. The dispense assembly comprises an outlet channel closable by a valve body and a chamber between the container and the valve body. The chamber is at least partly closed by a flexible membrane connected to the valve body and/or valve seat, such that pressurized beverage from the container filling the chamber forces the membrane into a position biasing the valve body and/or valve seat in a position closing the outlet channel. By pushing the membrane the valve body and/or the valve seat can be forced into a position opening the outlet channel. Preferably at least during use there is an open connection between said chamber and a beverage compartment of the container. There through the membrane can be maintained in a pressurized position by the pressure of the beverage.

Figure 1B:
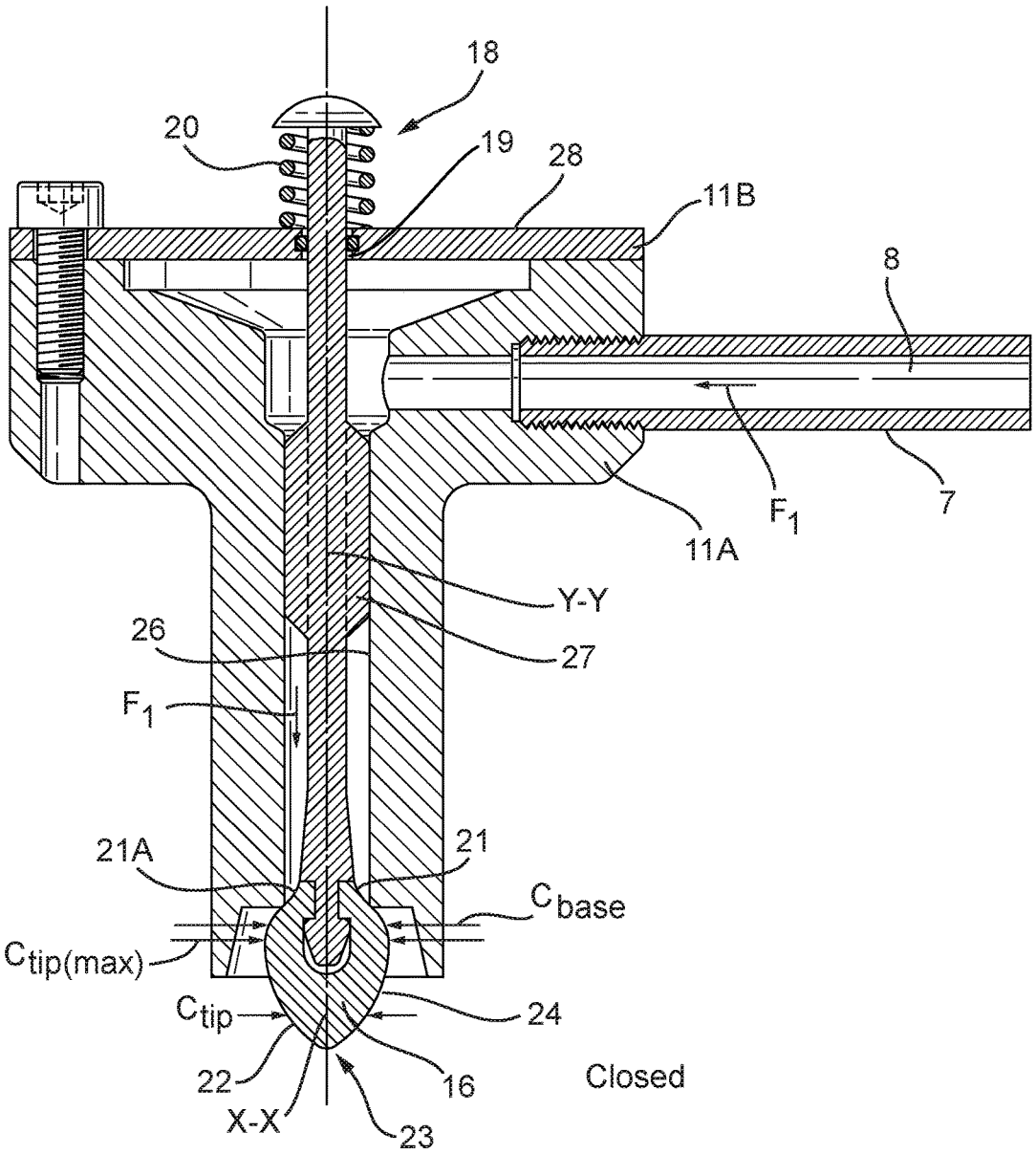
Figure 2A:
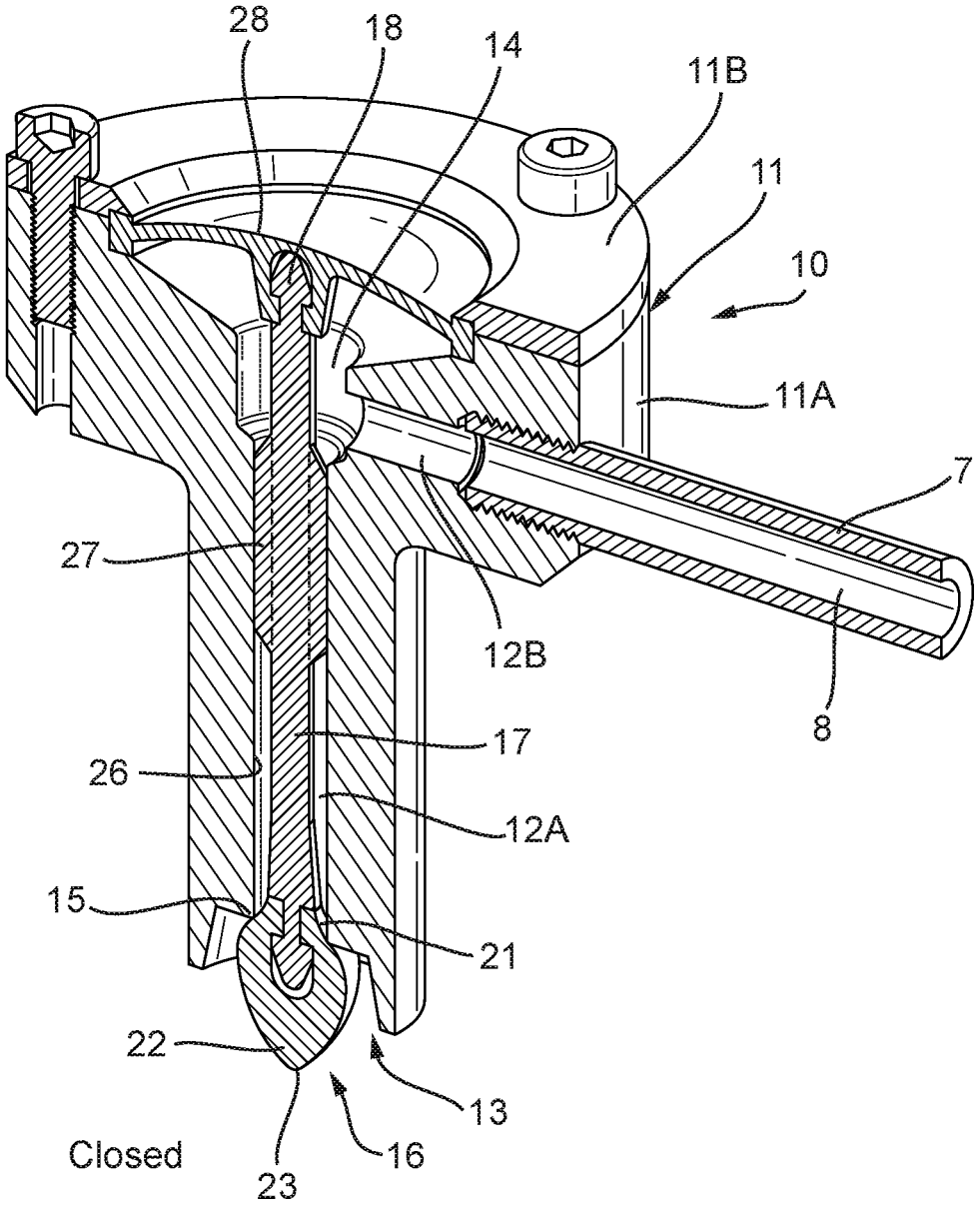
Figure 3A:
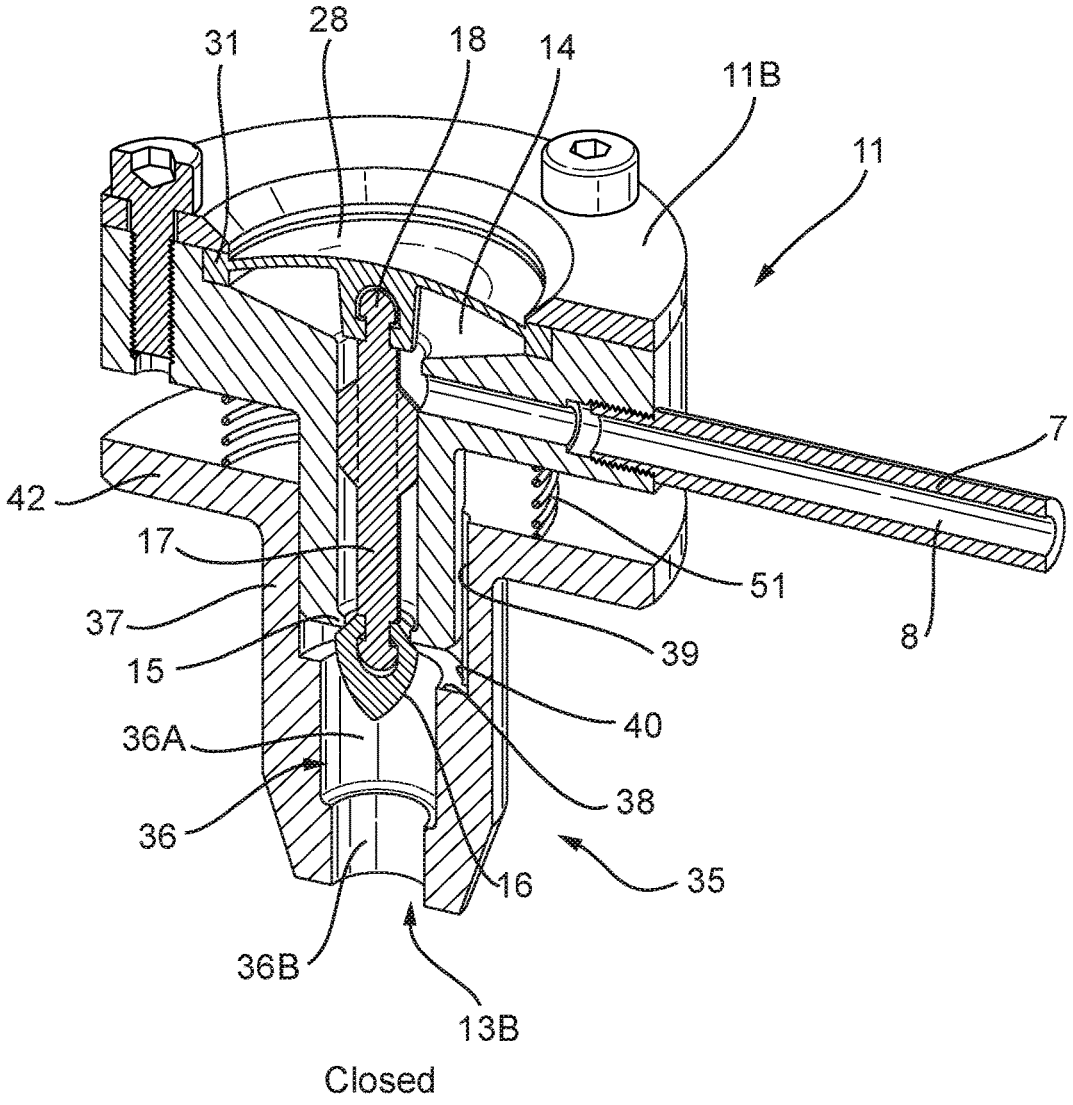
Figure 4A:
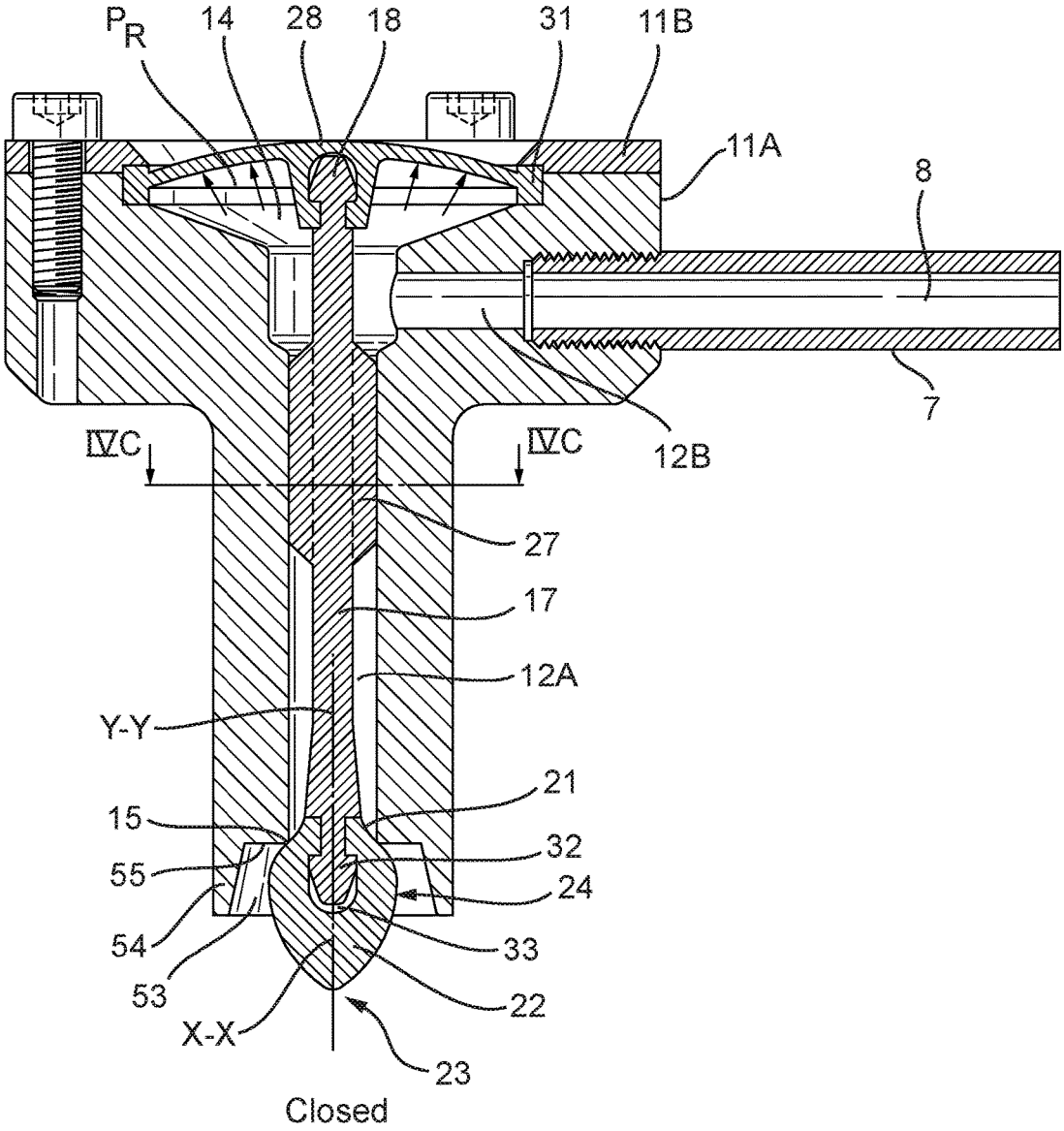
Figure 4B:
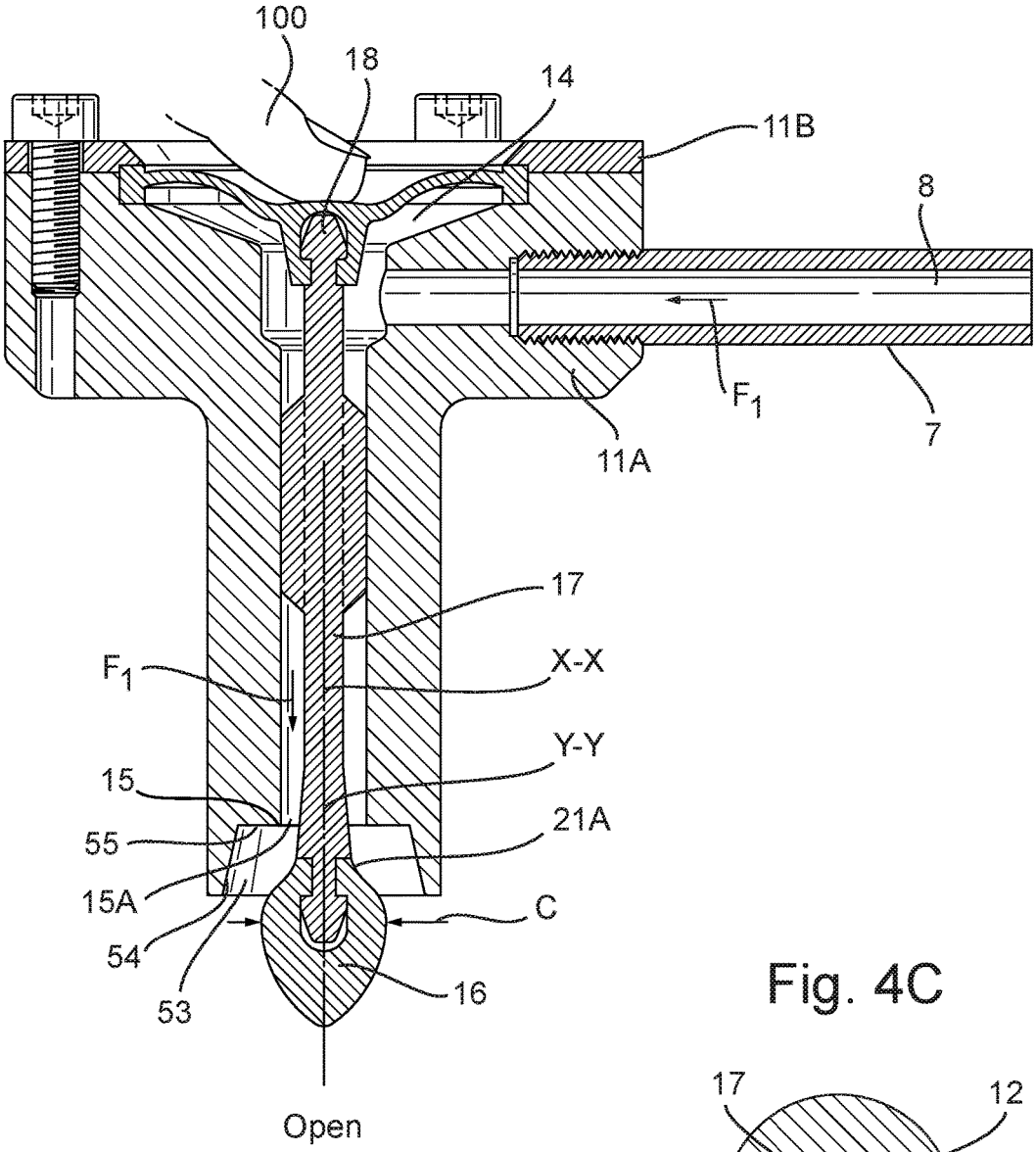
Figure 4C:
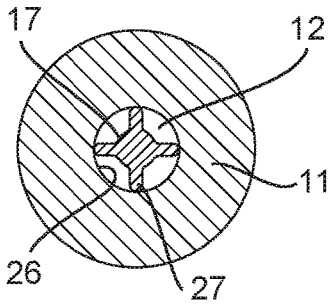

In the following embodiments of a dispense assembly and a container according to the disclosure shall be discussed, with reference to the drawings, in which:

FIG. 1 shows schematically a container with a dispense assembly connected thereto;

FIGS. 1B and C a dispense assembly, in cross sectional view, in closed and open position respectively;

FIGS. 2A and B in perspective view, in cross section, show a second embodiment of a valve assembly, or part thereof, in open and closed positions respectively;

FIGS. 3A and B in perspective view, in cross section, show a third embodiment of a valve assembly, or part thereof, in open and closed positions respectively;

FIGS. 4A and B show the second embodiment, in cross sectional view;

FIG. 4C a cross sectional view along the line IVC-IVC in FIG. 4A.

Figure 5A:
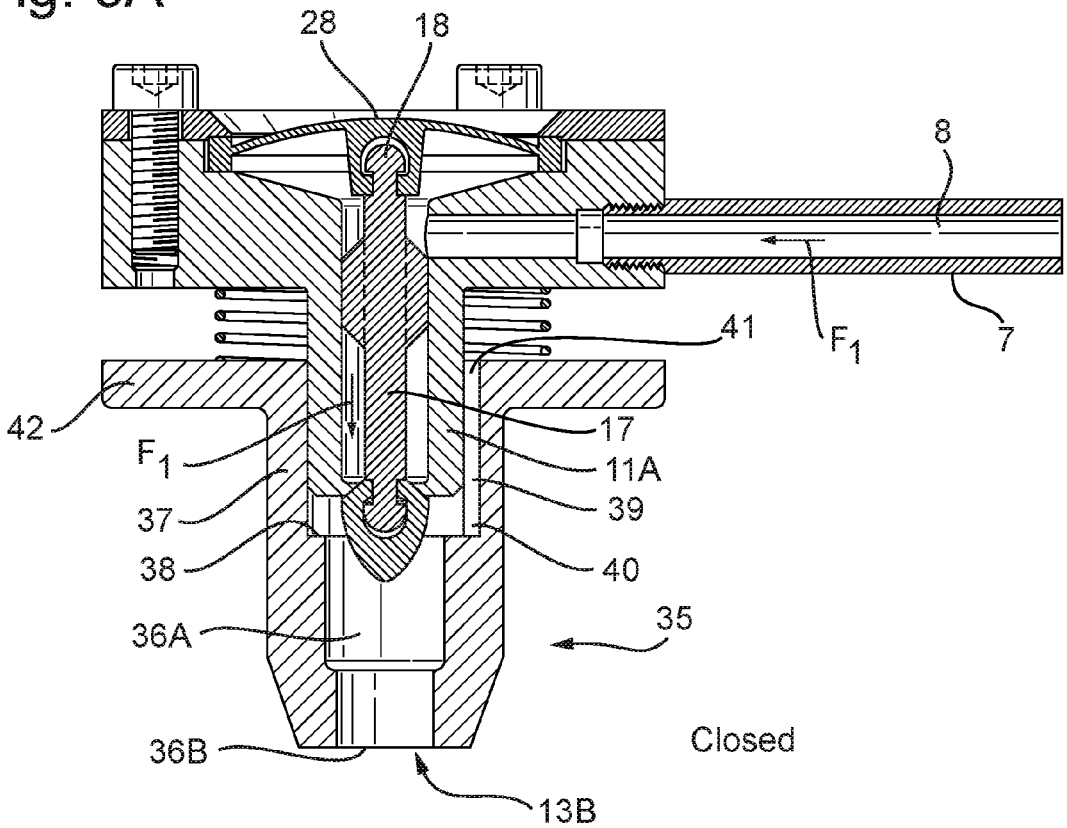
Figure 6:
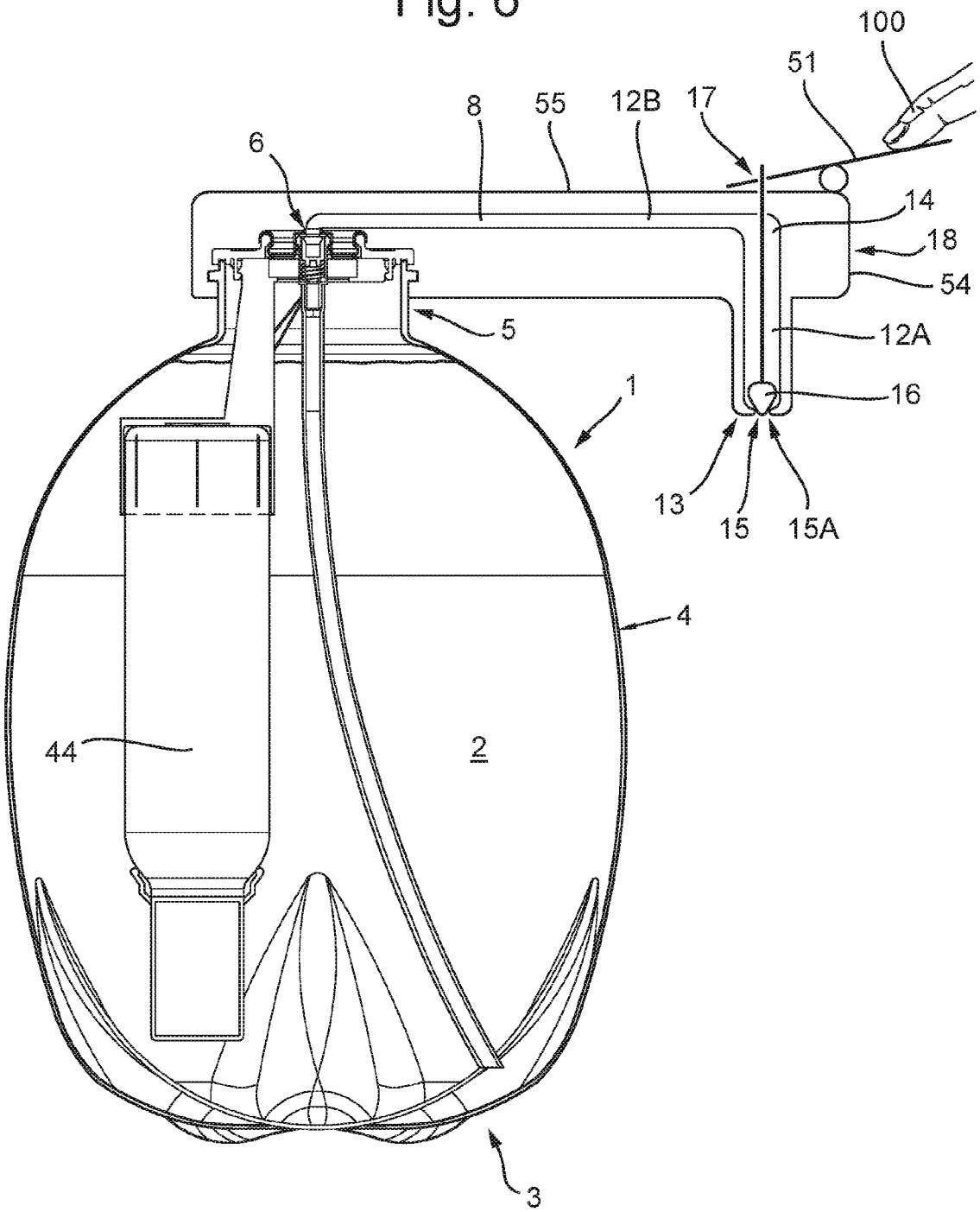
Figure 6A:
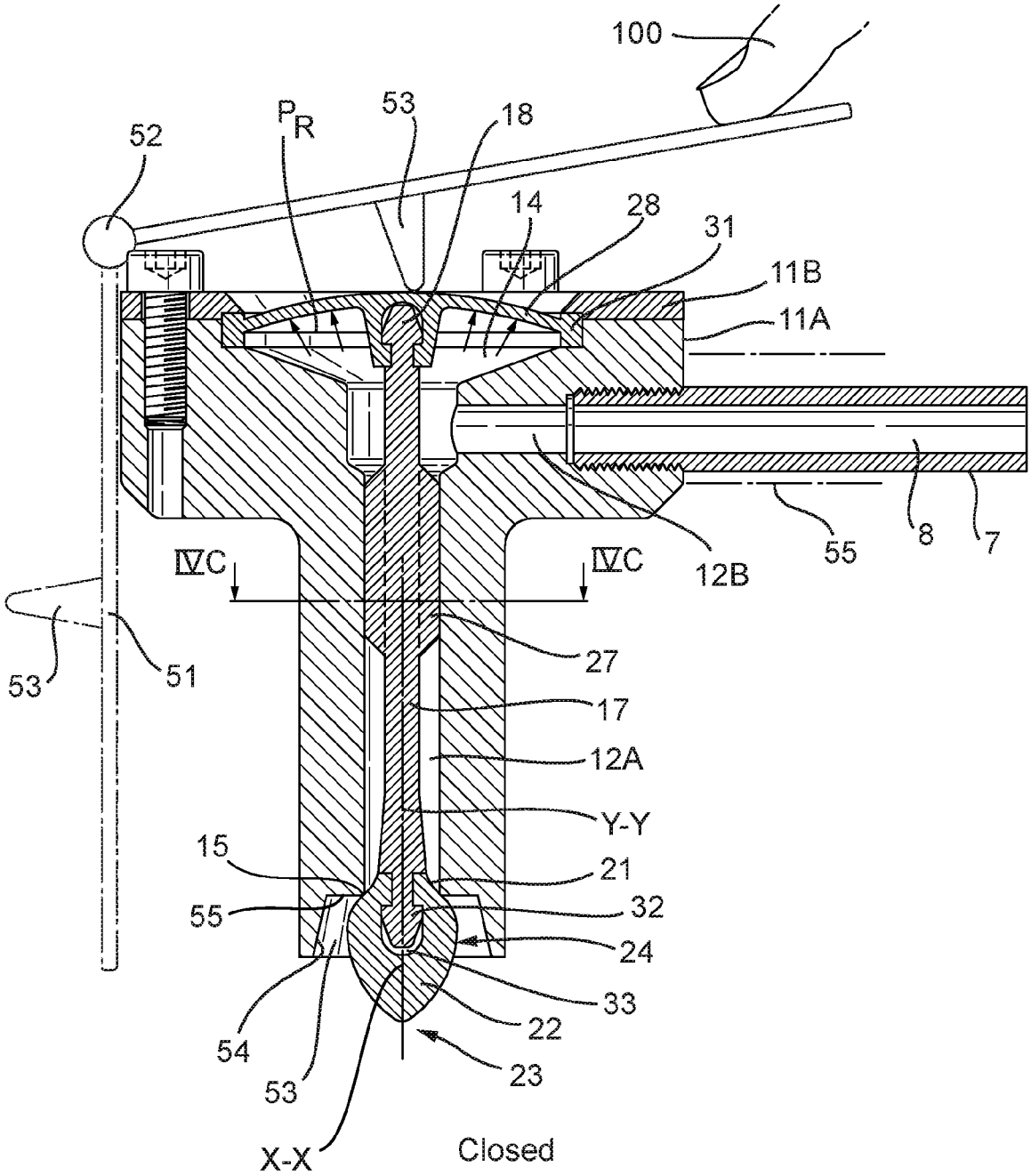
Figure 7A:
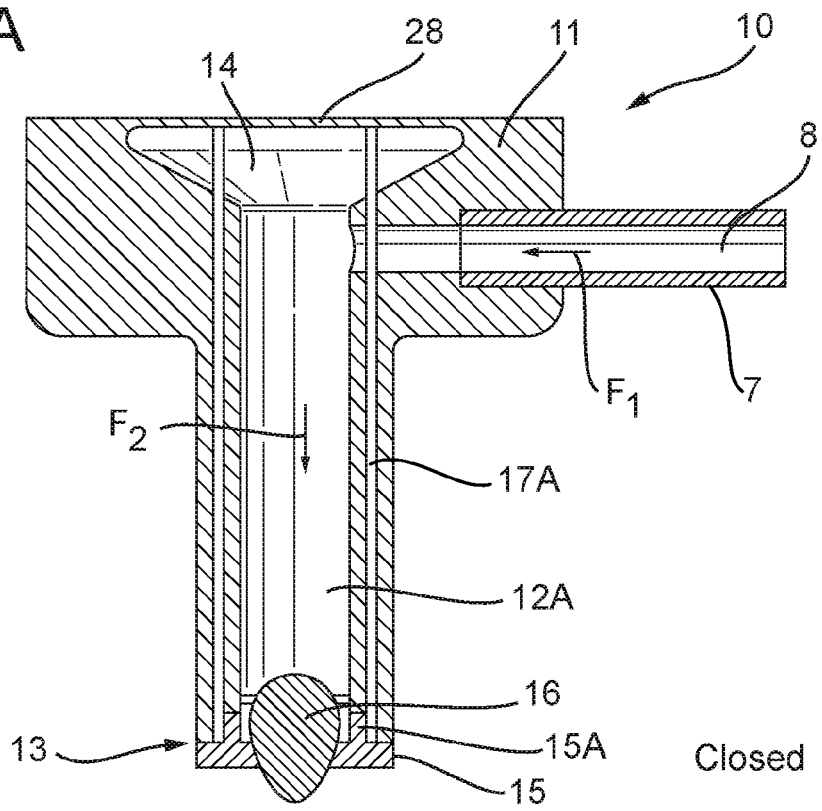
Figure 7B:
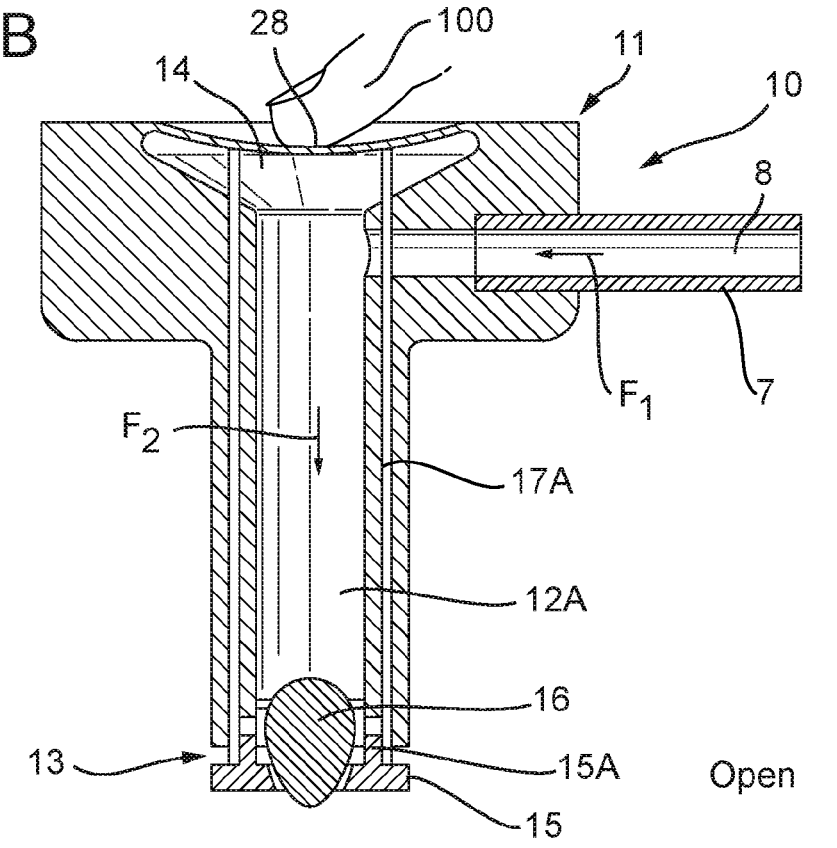

FIGS. 5A and B show the third embodiment, in cross sectional view;

FIG. 6 shows schematically part of an alternative embodiment of a part of a dispense assembly;

FIGS. 6A and B show schematically an alternative embodiment for a lever operated valve; and FIGS. 7A and B an alternative embodiment.

In this disclosure embodiments of a dispense assembly and container are shown by way of example only. These embodiments should not be considered as limiting the scope of disclosure in any way or form. In these embodiments the same or similar elements or features have the same or similar reference signs.

In this description beverage dispensing assemblies and containers shall be described with reference to dispensing carbonated beverages, such as but not limited to beer. However the same or similar assemblies and containers can be used for other beverages or different liquids. In this description pressurized beverage may be understood as at least including but not limited to beverages which comprise gas, such as carbonated beverages, for example beer or gaseous water, as well as beverages which are pressurized in the container, for example by an external pressuring gas source or mechanical means, or combinations of both.

In this description words like substantially or about should be understood as indicating that small deviations are possible for a value or position the word is used with, for example 20%, 15% or 10% deviations. This should include at least deviations which a person skilled in the art would normally understand as equivalent or leading to the same or similar results, or which such person would readily understand to be encompassed too, or which is within normal manufacturing ranges. For example the valve body can be substantially bullet shaped, wherein substantially bullet shaped should, with reference to the valve body, be understood as meaning to describe the shape of the valve body resembling the shape of a bullet, especially as shown in the drawings. Such bullet may have a non-spherical and non-cylindrical shape, but having a shape which is elongated, has a blunt first end, formed by a base, and a more pointed opposite second end, formed by a tip with an end which is preferably not sharp. The tip can have an outer surface which is at least partly curved outwardly. The shape of the tip may be such that in cross section the tip has a parabolic shape. In this description outwardly curved with respect to the outer surface of the tip of the valve body should be understood as including at least a surface which is convex at the outside over most of the surface.

In the present disclosure a dispense assembly or tap can be provided which is closed at least by pressure of beverage in the system, preferably such that with increasing pressure of the beverage the tap is closed tighter by said increasing pressure. To this end a membrane can be provided, such as shown in the drawings, closing off a beverage containing chamber in the outlet. Alternatively this can be a different movable and/or deformable wall, such as a piston, engaged and pressurized by the beverage.

FIG. 1 schematically shows a container 1 containing a beverage, especially a carbonated beverage, such as beer, and has a bottom 3, a side wall 4 and a neck 5 with an outlet opening 6 to which a dispense tube 7 is connected. The tube 7 can be rigid, flexible or part rigid, part flexible. In embodiments the tube 7 can at least in part be an integral part of the container 1. The tube 7 comprises a part of an outlet channel 8, as will be discussed hereafter. Within the container 1 a compartment 2 is formed in which the beverage B is enclosed. This compartment 2 may be directly defined by the bottom 3, wall 4 and neck 5, or can be defined by for example a flexible bag or such element within the container 1, such as in a Bag-in-Container (BIC) or Bag-in-Bottle, Bag-in-Box or Bottle-in-Bottle (BIB). A dip tube 9 may extend from close to the bottom 3 to the outlet opening 6, connected to the tube 7, such that when the beverage is pressurized beverage can flow through the dip tube 9 into the channel 8, such that it can be dispensed. A valve V, such as for example an aerosol type valve, or a breakable seal can be provided in the opening 6. When dispensing beverage from the compartment 2 an fluid connection shall exist between the compartment 2 and the tube 7.

At the end 9 of the tube 7 opposite the neck 5 a dispense assembly 10 is provided, for example connected to the tube 7 or partly part thereof. This dispense assembly comprises a housing 11 through which an outlet channel 12 extends, in FIG. 1 represented by the dotted line, between an outlet end 13 and a junction 14, which junction 14 is in fluid connection with the channel 8 of the tube 7. Thus in use beverage can flow from the compartment 2 of the container 1, through the channel 8 into said junction 14 and then into the outlet channel 12. Alternatively the junction 14 can be provided between a first part 12A of the outlet channel 12 and a second part 12B of the outlet channel 12, wherein the second part 12B is connected to the channel 8 of the tube, as shown for example in FIGS. 2-5. In another embodiment the second part 12B of the channel can be directly connected to the neck 5 and/or the dip tube 9 and/or the reservoir 2, eliminating the tube 7.

Figure 1C:
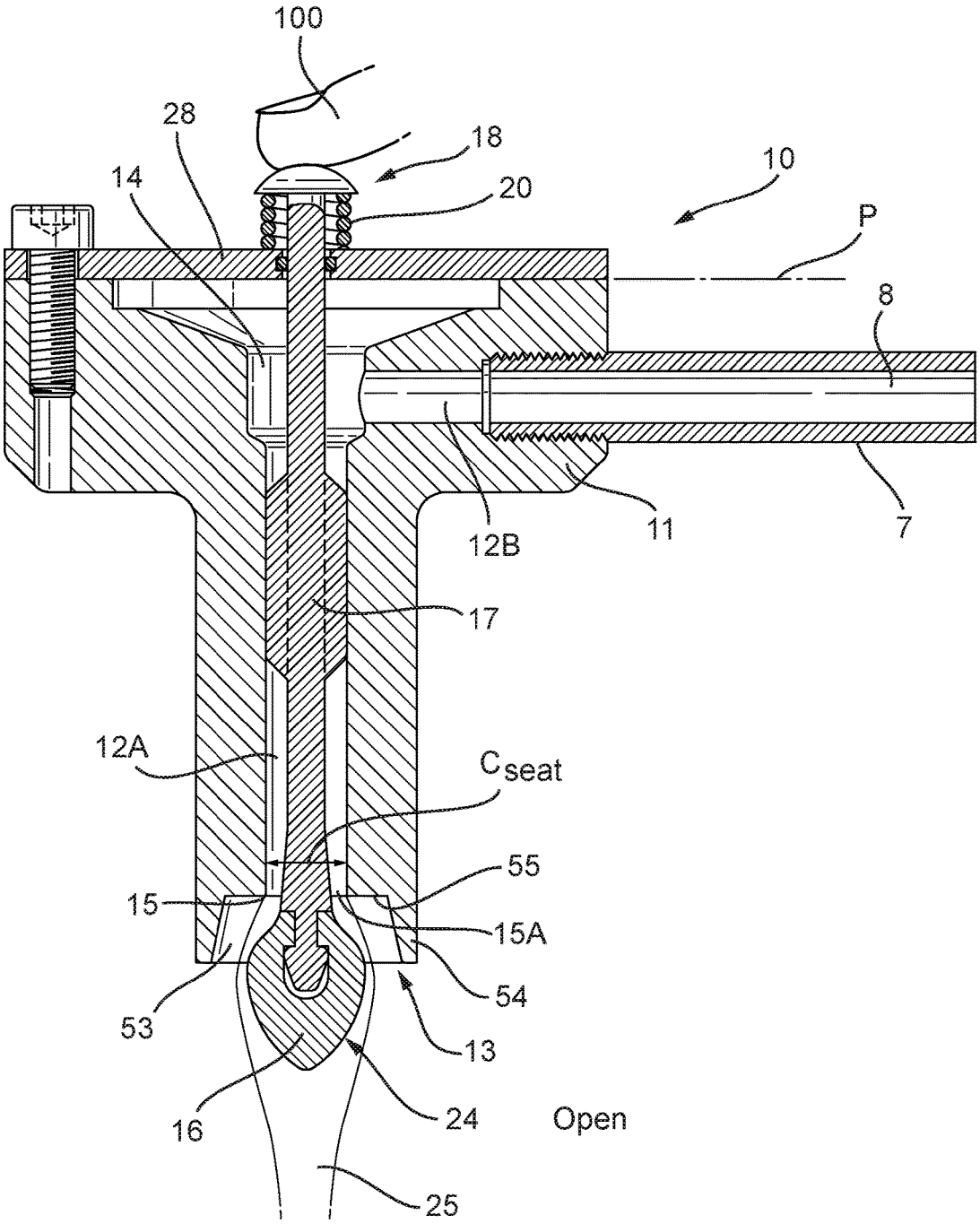

As can be seen in FIG. 1 an end of a valve body 16 can extend outside the housing 11, or at least outside the outlet end 13 of the channel 12, and can be formed such that liquid, especially beverage, dispensed through said channel will flow over the valve body surface 24 towards said end of the valve body 16, for example as will further be discussed, forming a concentrated flow or stream of the beverage down into for example a glass G or such container held below said housing 11. When the valve is closed any remaining beverage connected to the valve body 16 can flow off past said end, such that dripping is minimized and mostly confined to the instant directly after closing the valve. A concentrated flow 25 or stream of beverage B in this context should be understood at least as encompassing a flow of beverage forming a substantially cylindrical, full stream of beverage, preferably without significant sputtering of beverage outside said flow. Such flow is preferably substantially non turbulent, such as substantially laminar. In FIG. 1C such flow 25 is schematically shown and can be a jet.

In the embodiment of FIG. 1 the assembly 10 can be hand held, such that it can be positioned in a desired orientation and position, especially when the tube 7 is at least partly flexible. Alternatively the dispense assembly 10 could be fixed to the container 1 or for example to a housing in or to which the container 1 can be position of coupled, for example a tapping device.

In the embodiment shown in FIGS. 1B and C at the outlet end 13 a ring shaped valve seat 15 is provided. A valve body 16 is provided such that in a closed position it can close off against the seat 15, for preventing beverage from being dispensed, or in an open position can open said outlet opening 13 for allowing beverage to be dispensed. In this embodiment the valve body 16 extends largely outside the channel 12 and outside the housing 11 and is moved towards the channel seat 15 for closing off the outlet end 13, and moved further out for opening said outlet opening 13. The valve body 16 is connected to a stem 17 extending through the first part 12A of the channel 12 and through the junction 14 and has an end 18 longitudinally opposite the valve body 16, which can be engaged, for example by a finger 100 for moving the valve body 16, at least from the closed position into the open position. In this embodiment schematically the stem 17 is shown extending through an opening 19 in the housing 11, sealed in order to prevent leaking, such that said end 18 can be engaged from outside the housing 11. A spring 20 is provided between the housing 11 and the end 18, biasing the valve body 16 against the seat 15. By pushing the end 18 towards the housing 11, the valve body 16 is forced into the open position. The top wall 28 of the chamber 14 supporting the spring 20, can be somewhat flexible, such that it can be pushed away from the channel 12A by beverage pressure inside the chamber 14, pulling the valve further closed. The higher the pressure in the chamber 14, the firmer the valve body 16 will be pulled against the seat 15 and thus the firmer the valve will be closed.

During normal use when dispensing beverage the beverage will flow from the container towards the outlet end 13, which is here defined as the direction of flow $F_1$ of the beverage through the channel 12, and, if applicable, channel 8. Upstream is considered a direction or side of an element against the direction of flow $F_1$ through the channel 12 or channels 12, 8, whereas downstream will be considered a direction or side of an element in the direction of flow $F_1$. Thus a part of an element upstream is considered in the direction of flow $F_1$ to be closer to the container 1 than a downstream part thereof.

The valve body 16 has a shape with a base 21 facing in a direction against the direction of flow $F_1$ and a tip 22 with an end 23 facing in the direction of flow $F_1$, wherein the tip 22, between the base 21 and the end 23, has an outwardly curved outer surface 24. The end 23 is preferably rounded in the down stream direction and is more preferably substantially continuous with the outer surface 24. The base 21 is connected to the stem 17 and has a maximum cross section $C_{base}$ which is larger than the cross section $C_{seat}$ of the opening 15A in the seat 15, such that the base 21 can close off the opening 15A of the seat and thus the outlet end 13. The base 21 can for example have a substantially truncated cone shape, reducing in cross section in the upstream direction, such that it fits partly inside the opening 15A. Alternatively the outer surface 21A of the base 21 could be curved, for example such that the base is substantially spherical or a segment of a sphere. In embodiments either the base 21 or the seat 15 can be of a pliable or compliant material, such as a relatively soft and/or flexible material, for example an elastomeric material or a rubber material. Preferably the other of the seat 15 and the base 21 is made of a harder material, such that in the closed position the base 21 seals firmly against the seat 15, preventing leaking of beverage. In an alternative embodiment both the base and the seat could be made of a pliable, flexible material.

The surface 24 of the tip 22 is substantially convex. The surface 24 is preferably such that the cross section $C_{tip}$ of the tip 22 reduces ever faster in the direction of the end 23. The cross sections as mentioned herein are taken substantially perpendicular to a longitudinal axis X-X of the valve body 16, which axis may be parallel to and preferably coincides with the direction of flow $F_1$ through the opening 15A and/or with a longitudinal axis Y-Y of the channel part 12A at said opening 15A. The valve body 16 is preferably rotation symmetrical relative to the longitudinal axis X-X. This can help a relatively even distribution of beverage over the surface 24 for forming the flow F.

The surfaces 21A and 24 are designed such that beverage engaging the base 21 when flowing through the opening 15A can be guided over the base surface 21A and from the base 21 over the outer surface 24 to the end 23, and forming a beverage flow or jet 25 when leaving the surface 24 at or near said end 23. It has been found that by the convex surface 24 connected to the base 21 the beverage will stay in contact with the surface 24 to at least close to the end 23, and will leave the surface 24 such that a jet 25 is obtained with a desirable profile. The jet 25 can be compact and well defined, flowing relatively straight downward, without splattering or sputtering of the beverage. Moreover, when the outlet opening 15A is closed by the valve body 16, any remaining beverage already passed said opening 15A will flow over said surface 24 to the end 23, such that it is concentrated at said end 23 and will fall down immediately. Especially when the surface 24 is relatively hard and smooth.

The material of the tip 22 is can have a relatively high surface tension, for example about 25 dyne/cm or higher, such as for example about 30 dyne/cm. The surface tension can for example be between 25 and 50 dyne/cm. The material of the tip 22 can for example be a hydrophobic material. The surface tension can for example be measured by the method of Zisman or Owens-Wendt. The material of one of the seat and the tip can be relatively hard, the other can be relatively soft. The material of the tip can for example have a Shore A hardness of more than 50, for example more than 60, such as for example between 60 and 100. Examples of materials which can be suitable for forming a tip 22 or seat can be a polypropylene block copolymer (impact copolymer), such as for example Moplen EP540P, a SEBS based thermoplastic elastomer (Shore A=61) such as for example Evoprene Super G931, or a SEBS based thermoplastic elastomer (Shore A=90), such as for example Cawiton MT990. In general TPE has shown to be a suitable material for the tip 22. These materials and different material properties have been disclosed by way of example and should not be considered as limiting.

In embodiments the tip 22 can have a maximum cross section $C_{tip}$(max) which is significantly larger than the cross section $C_{seat}$ of the opening 15A. For circular cross sections the diameter of the maximum cross section $C_{tip}$(max) of the tip 22 can for example be at least one-third larger than the diameter of the cross section $C_{seat}$ of the opening 15A, for example about twice as large. The cross sections are preferably chosen such that the beverage flowing through the opening 15A is forced to engage the base 21 and flow outward slightly over said base 21 before flowing onto the surface 24.

In the embodiments shown the stem 17 at least partly has a cross section such that beverage can flow passed it in the channel 12 but the stem 17 will be guided by an inner wall of said channel 12. The cross section of this part of the stem, 17 can for example be as shown in FIG. 4C, substantially cross or star shaped, having fins 27 guided by the inner wall 26 of the channel 12.

In FIG. 1 the housing 11 comprises the junction 14, formed as a chamber from which the first channel part 12 extends downward in the drawings, the second channel part 12B extends side ways in the drawings in to said junction 14 and an upper wall 28 is provided closing off the chamber 14. The stem 17 extends through the opening 19 in said wall 28. The wall 28 can be relatively rigid, such that it does not deform under pressure of beverage flowing into the chamber 14. It such embodiment the valve formed by the valve body 16 and valve seat 15 is opened solely by pushing the stem 17 down. The wall 28 may be partly or entirely flexible, such that the volume of the chamber 14 can be changed by movement of said wall 28. In such embodiment pressure of beverage in said chamber 14 will push the wall 28 outward, in the drawings shown as upward, such that the end 18 is pushed further away from the seat 15, further closing the valve. When opening the valve by pushing down the stem 17, the wall 28 may be deformed also. Thus in such embodiment the force closing the valve can be provided by or aided by the pressure of the beverage, such that the higher the beverage pressure, the harder the valve body 16 will be pulled against the seat 15.

In FIG. 2-5 embodiments of dispense assemblies are shown, similar to that of FIGS. 1B and C, in which the wall 28 is flexible, and wherein the end 18 of the stem 17 is provided inside the junction or chamber 14, such that the wall 28 can be closed over the end 18. The wall 28 can for example be formed by a flexible and/or resilient membrane, such as a membrane made of plastic or rubber. As can be seen in embodiments the end 18 can be provided with a snap head 29, snapped into a snapping opening 30 at a side of the wall 28 facing the chamber 14. Thus the stem 17 is connected to the wall 28, such that a movement of the wall 28 can lead to a movement of the stem 17 in the direction Y-Y. In such embodiments the valve formed by at least the valve body 16 and seat 15 can be opened by pushing part of the wall 28 down into the chamber 14, towards the seat 15. Beverage will flow through the channel 12 and chamber 14 and out of the opening 13 passed and especially over the valve body 16. When the wall 28 is then released again, the wall 28 will be pushed back, outward from the chamber 14, by the pressure $P_R$ of the beverage B flowing into the chamber 14 and/or by resilience of the material of the wall 28. In this way the beverage pressure can aid in closing the valve. In such embodiments no additional springs have to be necessary for closing the valve.

In the embodiments shown by way of example only the housing 11 comprises a lower part 11A, comprising at least the first and second channel parts 12A, B and a lower part of the chamber 14, and an upper part 11B, which in these embodiments is shown as being generally ring shaped and bolted to the lower housing part 11A. A peripheral edge 31 of the wall 28 is enclosed between the two housing parts 11A, B for sealing and closing off the chamber 14. It will be clear that the same or similar configurations can be obtained in a different manner. In the embodiments shown by way of example only the valve body 16 is snapped onto a lower end 32 of the stem 17, by an opening 33 in the base 21. Alternatively other means for mounting the valve body to the stem can be used, such as bonding, screwing, welding or the like. In embodiments the valve body 16 may be made partly or entirely integral with the stem 17, for example by 2K molding or overmolding. Similarly the wall 28 may be made partly or entirely integral with the stem and/or the housing, for example by 2K molding or over molding.

In embodiments shown the wall 28, which may also be referred to as membrane, can for example be generally dome shaped, such that in a rest position with the valve closed, such dome shape exists with a top facing outward from the chamber, whereas for opening the valve the dome shape is pushed away by pressing it down, reducing the volume of the chamber 14. In all embodiments the wall 28 can be a membrane. By using a dome shape an advantage can be obtained that stress in the membrane or wall 28 is minimized, since when deforming the membrane it can be deformed from an outward bulging dome into an inward bulging dome, and does not have to be stretched significantly between or in such position. Moreover the dome shape can provide a biasing force closing the channel.

In the cross sectional views as shown the channel parts 12A and B extend at substantially right angles relative to each other, such that a main direction of flow of beverage through the first channel part 12A extends at substantially right angles to a main direction of flow of beverage through the second channel part 12B. As is shown schematically in FIG. 1 the channel parts 12A, B can also enclose a different angle. Such angle can for example be between 30 and 150 degrees, such as between 60 and 120 degrees. In the embodiments shown the longitudinal direction of the stem 17, which may coincide substantially with the axis Y-Y, extends substantially perpendicular to a plane P defined by the peripheral edge 31. In alternative embodiments the longitudinal direction of the stem 17 may extend at a different angle relative to said plane P, for example an angle between 45 and 90 degrees, such as between 60 and 90 degrees, for example but not limited to between 70 and 90 degrees. Such angles can for example be chosen depending on ergonomics, available space, preferred direction of dispensing and the like.

Figure 2B:
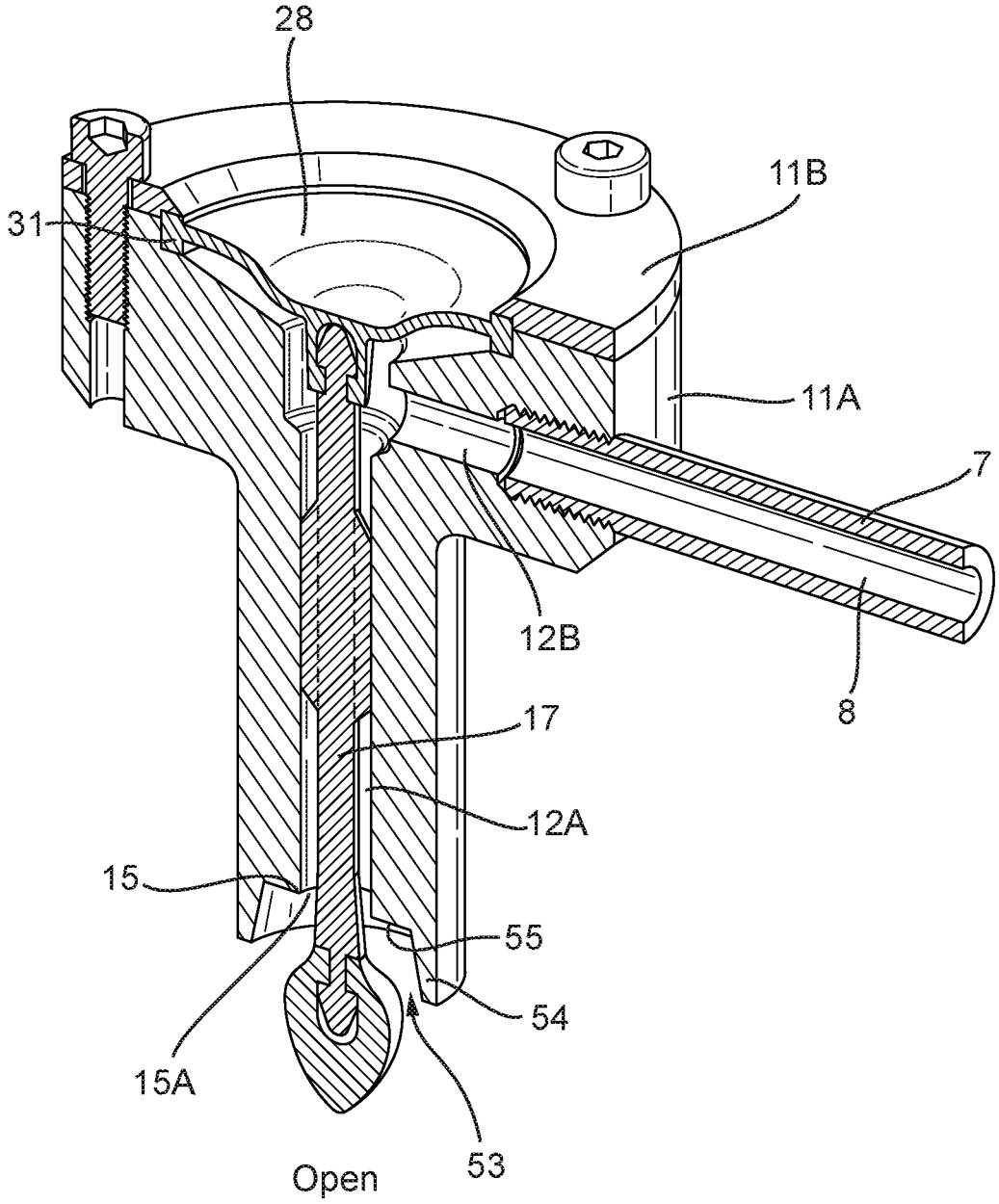

In the embodiments shown in FIGS. 1, 2 and 4 at the outlet end 13 side of the housing 11 a recessed area 53 can be provided, surrounding or enclosing part of the valve body 16 at a distance. The recessed area 53 to that end is defined by a peripheral wall portion 54 extending spaced apart from the surface 24 around the valve body 16, and a surface area 55 adjacent to or including the valve seat 15. Such recessed area and especially the wall 34 may aid in preventing beverage spraying when leaving through the opening 15A. Alternatively the recessed area can be formed differently or can be absent.

Figure 3B:
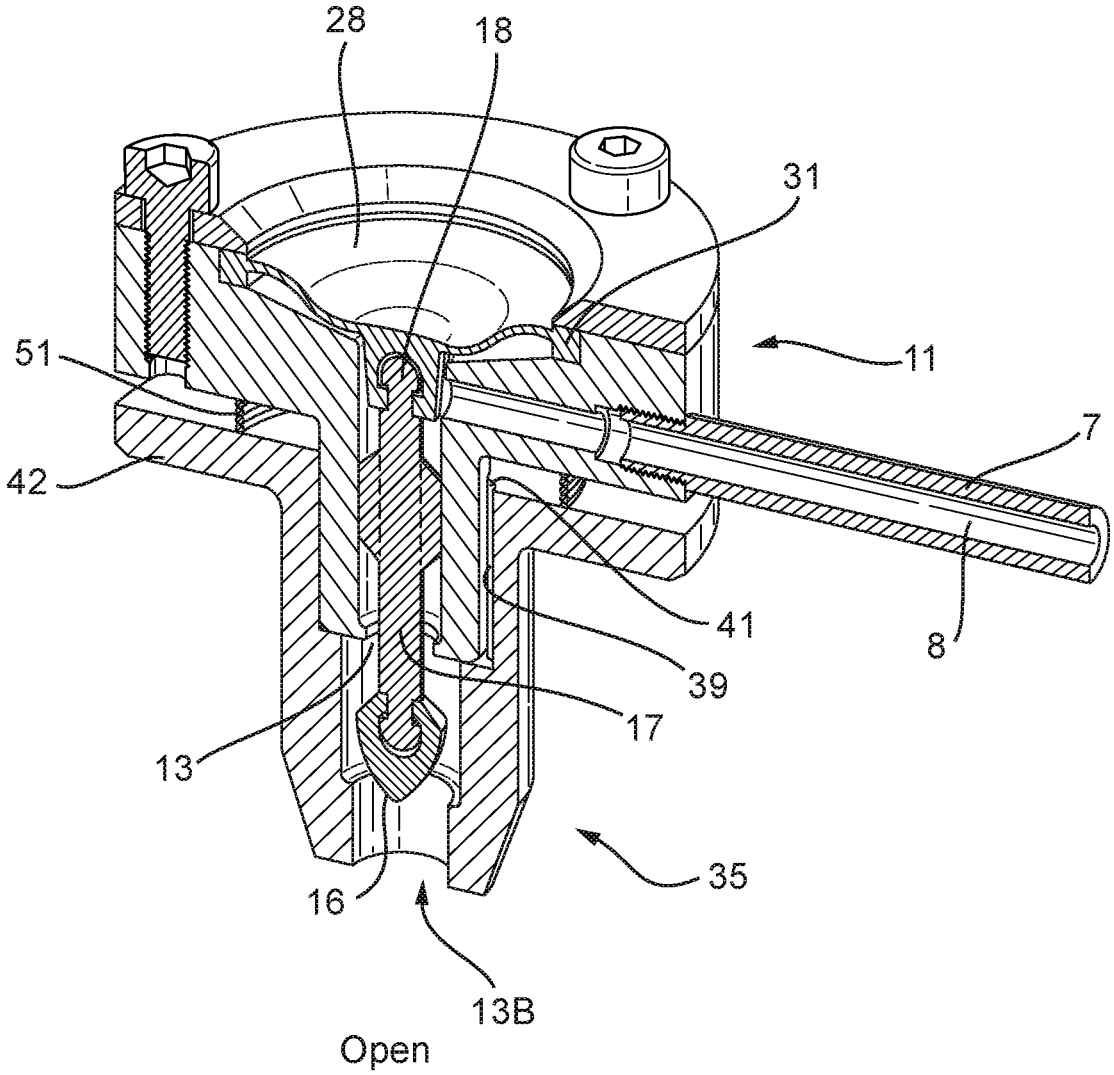
Figure 5B:
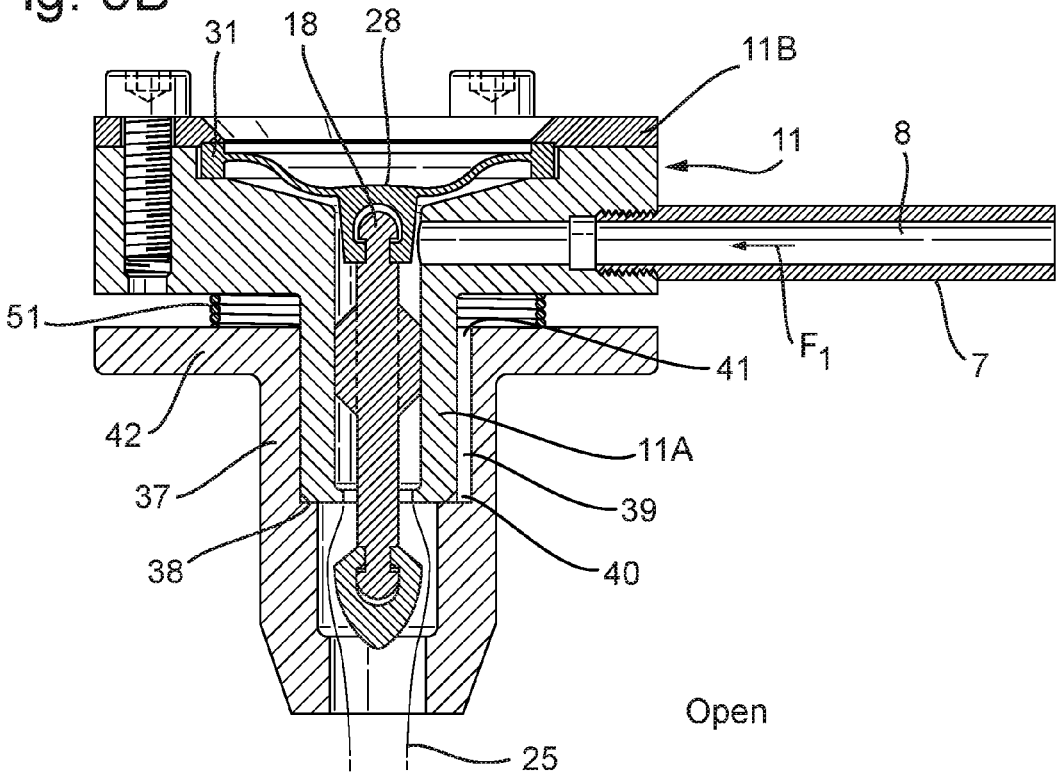

In the embodiment of FIGS. 3 and 5 the assembly 10 comprises a first housing part 11 through which at least the first part 12A of the outlet channel 12 extends, and a further housing part 35 slidingly surrounding at least part of the first housing 11A. The further housing part has a second channel 36 in which the valve body 16 extends. The second channel 36 can have a first portion 36A extending around the valve body 16 and a second portion 36B, narrower then the first portion 36A, defining an outlet 13B for beverage from the second channel 36. The second part 36B could however also be omitted. The further housing part 35 has a portion 37 extending around the first housing part 11A, wherein between the portion 37 and the channel 36 a shoulder 38 is formed. This shoulder 38 is such that when the further housing part 35 is pulled up, towards the first housing part, such movement is limited by the shoulder 38, which may seal against the end of the first housing part 11A. When the further housing part is released it may be pushed and/or pulled away from such sealing engagement again, for example by gravity and/or a spring force, schematically shown by spring 51. The further housing part 35 may for example be provided with a flange 42 or such engagement part, for pulling it up against the first housing part 11A, for example when pushing down the membrane 28 at the same time for opening the valve. Beverage can then flow from the channel 12, passed and especially over the valve body 16 and out of the second channel 36. The wall of the second channel 36 may aid on providing a well defined flow 25.

Between the first housing part 11A and the portion 37 of the further housing part 35 at least one aeration channel 39 can be provided, having an end 40 at the shoulder 38, and an opposite end 41 opening into ambient air. When the shoulder 38 seals against the first housing part 11A the first end 40 of the channel 39 is closed. No air can flow into the second channel 36 through said aeration channel 39. When closing the valve again the further housing part 35 may be released, such that the opening 40 of the aeration channel is opened again, allowing air to flow in through said aeration channel, behind any amount of beverage still present in the second channel when the valve body 16 closes against the seat 15. This means that said remaining beverage may even better flow away, preventing extended dripping after closing the valve.

As can be seen schematically in FIGS. 1 and 6, in embodiments the container can be provided with a pressurizer 44 for pressurizing the beverage B inside the compartment 2 and/or by the compartment 2, such that the container 1 can be used as a stand alone, self contained dispensing system, without the need for other appliances, such as for example a tapping device or external CO2 supply which would have to be connected to the container, for example by a consumer. Such pressurizers are well known in the art and are for example used in DraughtKeg® as marketed by Heineken, The Netherlands. Such pressurizers 44 comprise a compartment with pressurized gas, such as CO2, for example a gas cartridge, and a pressure regulator 44*a*, preferably controlled at least by the pressure in the compartment 2, for maintaining a relatively constant pressure of the beverage, for example an equilibrium pressure of the gas in the beverage. Alternatively a container according to the present invention can be pressurized differently, for example by an external pressure source.

In the embodiments shown the valve body has a smooth and continuous surface, though it could be possible to provide some texture on the surface, for example grooves and/or ridges on a surface part close to the end 23, similar to a citrus press, for further guiding the beverage over and along said surface. In the embodiments shown the valve body can be made of a single material, such as plastic or rubber, for example a soft plastic such as an elastomeric material, or a relatively hard plastic, as discussed. In embodiments the valve body can be made of two or more materials, such as a base made of a first material and a tip of a second, the second material being harder than the first. This can be made for example by co-injection, 2K molding or by assembling. The base could in embodiments be part of the stem.

FIG. 6 shows schematically a container according to the present disclosure, in an alternative embodiment. In this embodiment the dispensing assembly 10 is directly connected to the container 1, by a relatively rigid tube or channel 8. In this embodiment the channel 8 is included in a housing 11 directly mounted to or even integral with the neck 5. At a side of the housing 11 opposite the neck 5 the dispense assembly is provided, comprising a stem 17 with a valve body 16 near a seat 15 at the end of a channel part 12A. In this embodiment the valve body 16 is provided such that by pulling it up into the channel part 12A it is pulled away from the valve seat 15, opening the opening 15A. Again beverage can flow through the channel 8 and channel part 12A and out of the opening 15A along a surface 24 of the valve body 16, whereas when closed the remaining beverage will directly flow off the valve body, preventing undesired, prolonged dripping. In a similar embodiment a dispense assembly 10 of one of the other embodiments could be used. In this embodiment the stem 17 is pulled upward by a lever 51, connected to the end 18, such that with the finger 100 pushing one end of the lever 51 the stem 17 is moved up, opening the beverage valve formed by at least the valve body 16 and seat 15.

Figure 6B:
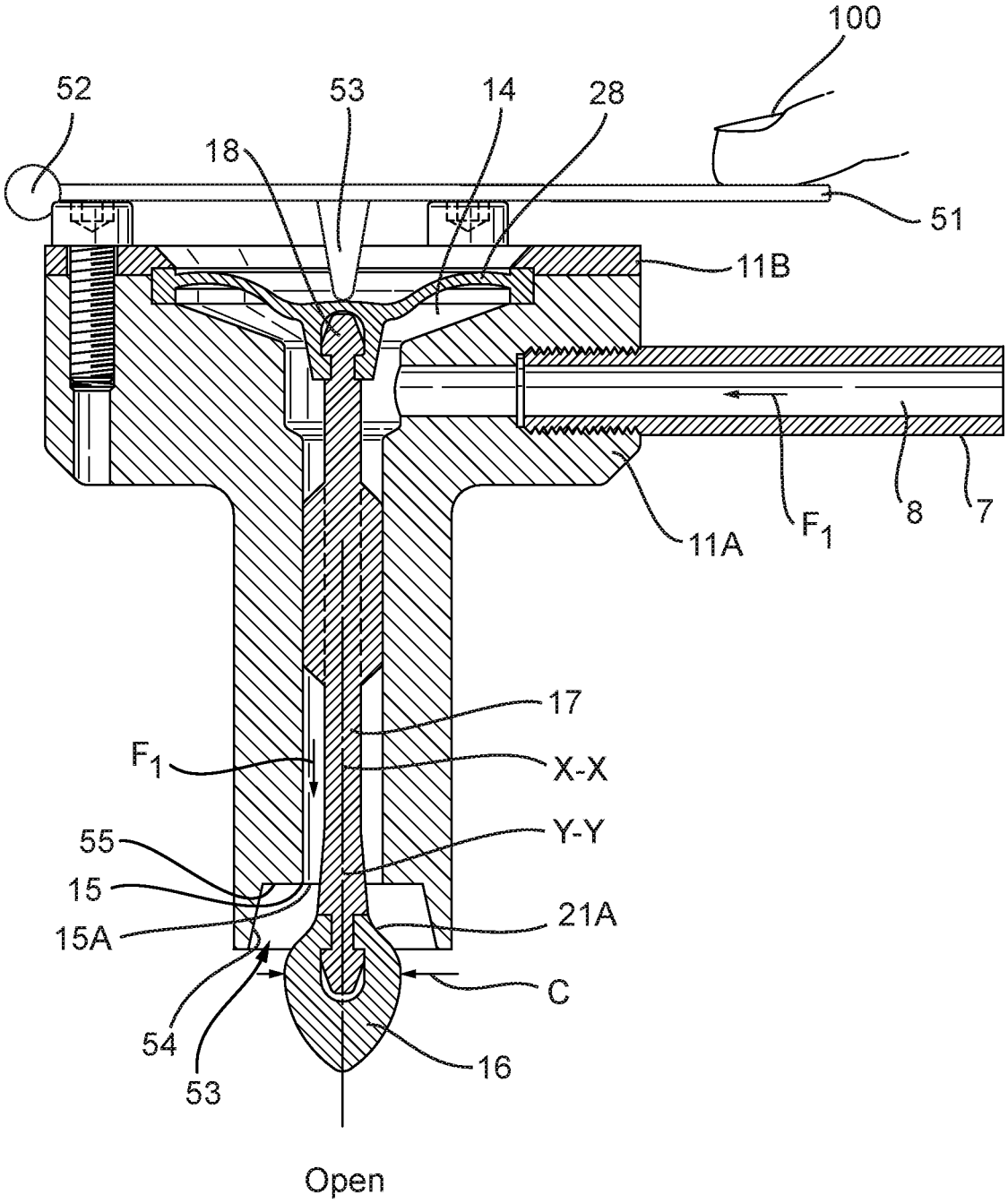

FIGS. 6A and B show an alternative embodiment of a dispensing assembly or part thereof, lever operated. The embodiment shown is comparable with that of FIGS. 4A and B, but similarly a lever 51 could be used with the other embodiments shown, and for example in a container comparable with that of FIG. 6. In this embodiment in stead of a finger 100 as shown in FIG. 4B a lever 51 is provided, pivotable around a pivot 52. The pivot 52 may for example be provided at an end 54 of a housing 55 as shown in FIG. 6A or on the housing 11A, 11B. The pivot comprises an engagement element 53 engaging the membrane 28 for pushing it down, for example from a position as shown in FIG. 6A to a position as shown in FIG. 6B. In FIG. 6A the membrane or wall 28 is pushed upward to a dome shape by the resilience of the material of which it is made, it's shape and/or internal pressure, especially pressure of the beverage in the chamber 14. This pushes the lever 51 up as well. By placing a finger 100 at an end of the lever 51 and pushing it down, opening the valve, especially against the pressure inside the chamber 14 is made easier. Preferably the lever can be pivoted away from the membrane 28, by pivoting it around the pivot 52, in FIG. 6 in a direction against the clock, for example to a position alongside the housing 11. This makes the lever 51 inoperative, for example during storage and shipping. A consumer can then simply bring the lever 51 to the position as shown in FIG. 6A, in order to make it operative.

In embodiments such as shown in FIGS. 6 and 6A and B the lever can also be connected to the membrane 28 and/or the stem 18, which may for example be suitable if the membrane 28 is insufficiently resilient for it to be brought into the dome shape by itself and/or the beverage pressure when the valve is open or for example in embodiments as shown in FIGS. 1A and B.

In an alternative embodiment as shown in FIGS. 7A and B the valve body 16 is enclosed within the beverage channel 12A, between the seat 15 and the chamber 14 covered by the membrane 28. In this embodiment the valve body is fixed in position relative to the channel 12A, whereas the seat 15 is connected to the membrane 28, for example by push rods 17A, such that by pushing the membrane 28 down towards the outlet of the channel 12A, the seat will move away from the valve body, allowing beverage flow passed the body and through the seat. When the membrane is released the valve seat 15 will be pulled up again through the membrane 28 being pushed outward from the chamber 14 again by at least the pressure of the beverage in said chamber 14 and/or the resilience of the membrane 28. The seat 15 can have a guard 15A reaching up into the channel 12A in order to prevent beverage from flowing outward between the end of the channel 12A and the seat 16.

In the present disclosure different embodiments of dispense assemblies, and of containers with such dispense assemblies have been disclosed and discussed, by way of example only. Many different embodiments are possible with the scope of the present disclosure. For example a container can be provided without a dip tube. The container can be placed differently, for example with the opening 6 to a side or with the neck and opening facing downward. The neck 5 can be open, forming the opening 6 directly, with the channel 8 or channel 12 or chamber or junction 14 connected directly to the such opening 6. In embodiments the dip tube 9 can be formed by the channel 8 and/or 12. In embodiments the channel 8 and the channel 12 can at least in part have generally parallel main directions of flow. In all embodiments operation of the valve, that is movement of the stem and/or valve body, can be obtained by mechanical means such as but not limited to a lever construction. In the embodiments shown the stem 17 with the valve body is moved relative to the housing 11, especially relative to the seat 15. In other embodiments part of the housing 11 and/or the seat 15 can be moved relative to the valve body. In embodiments the valve body and/or seat could be provided differently, using a membrane as disclosed, pressurized by the beverage and/or material resilience, for biasing the valve into a closed position. In embodiments the valve and/or seat could be provided as disclosed herein, whereas the operating mechanism for moving the valve body and/or seat could be provided differently, for example mechanically or electro mechanically, wherein the valve body can still be shaped and positioned for guiding the flow of beverage along and over it's surface for forming a flow 25. These and many other variations, including but not limited to all combinations of examples, features and parts of the embodiments disclosed are considered to have been disclosed herein.

The invention claimed is:

1. Dispensing assembly comprising a container, containing a pressurized beverage, connected to or provided with a dispense assembly, wherein the dispense assembly comprises an outlet channel closable by a valve body and a chamber between the container and the valve body, which chamber comprises a movable and/or deformable wall part connected to the valve body or a valve seat, which movable and/or deformable wall part forms a closed wall part of the chamber, such that pressurized beverage from the container filling the chamber forces the movable and/or deformable wall part outward with respect to the chamber, into a position in which the valve body and/or the valve seat close off the outlet channel and by pushing the movable and/or deformable wall part inward relative to the chamber the valve body and/or the valve seat can be forced into a position opening the outlet channel.

2. Dispensing assembly according to claim 1, wherein the container is provided with a pressurizer, comprising at least a pressurized gas and a pressure regulator, for keeping the beverage within the container pressurized.

3. Dispensing assembly according to claim 2, wherein the beverage in the container is pressurized at a substantially constant overpressure compared to the surrounding of the container.

4. Dispensing assembly according to claim 3, wherein said substantially constant overpressure is about an equilibrium pressure of gas in the beverage.

5. Dispensing assembly according to claim 1, wherein the movable and/or deformable wall part is formed by a flexible membrane.

6. Dispensing assembly according to claim 5, wherein the membrane is substantially dome shaped.

7. Dispensing assembly according to claim 1, wherein the valve body is movable relative to a valve seat, between a closed position in which the valve body rests against the seat and an open position in which the valve body is spaced apart from the seat.

8. Dispensing assembly according to claim 7, wherein in the closed position a base of the valve body engages the seat in a sealing manner, wherein the base and/or the seat are made of a compliant material.

9. Dispensing assembly according to claim 8, wherein the outer surface of a tip of the valve body is made of a smooth material, having a surface hardness greater than the hardness of the said compliant material.

10. Dispensing assembly according to claim 7, wherein the valve body extends substantially outside the outlet channel, at least in the open position.

11. Dispensing assembly according to claim 1, wherein the valve body is connected to a stem extending through the outlet channel.

12. Dispensing assembly according to claim 11, wherein in said outlet channel the chamber is provided, at least partly closed by said movable and/or deformable wall part, connected to said stem.

13. Dispensing assembly according to claim 12, wherein the membrane is substantially dome shaped, having an edge connected to a wall of the chamber, and wherein the stem is connected to the membrane spaced apart from the edge.

14. Dispensing assembly according to claim 13, wherein in use beverage received in said chamber will force the membrane into or hold said membrane in said dome shape, biasing the valve body in a position closing the outlet channel.

15. Dispensing assembly according to claim 11, wherein the stem is guided at least by an inside wall part of the outlet channel.

16. Dispensing assembly according to claim 12, wherein the movable and/or deformable wall part is a flexible membrane.

17. Dispensing assembly according to claim 1, wherein the outlet channel has a first part comprised in a housing, wherein the outlet channel has a second part.

18. Dispensing assembly according to claim 17, wherein the first part has a outlet portion having a first main direction of flow and the second part has a second main direction of flow.

19. Dispensing assembly according to claim 18, wherein the first and second main directions of flow are non-parallel.

20. Dispensing assembly according to claim 19, wherein the first and second main directions of flow enclose an angle between 30 and 150 degrees.

21. Dispensing assembly according to claim 20, wherein the first and second main directions of flow enclose an angle between 60 and 120 degrees.

22. Dispensing assembly according to claim 21, wherein said angle is about 90 degrees.

23. Dispensing assembly according to claim 1, wherein at an outlet end of the outlet channel a recessed area is provided, surrounding at least part of the valve body at a distance.

24. Dispensing assembly according to claim 23, wherein the recessed area surrounds a valve seat.

25. Dispensing assembly according to claim 1, wherein the assembly comprises a first housing part through which at least part of the outlet channel extends, and a further housing part, slidingly surrounding at least part of the first housing, having a second channel in which the valve body extends, wherein the second channel comprises the valve seat for cooperation with the valve body.

26. Dispensing assembly according to claim 25, wherein the second channel has a first portion extending around the valve body and a second portion, narrower than the first portion, defining an outlet for beverage.

27. Dispensing assembly according to claim 1, wherein at least during use there is an open connection between said chamber and a beverage compartment of the container.

28. Dispense assembly comprising a container, containing a pressurized beverage, connected to or provided with a dispense assembly, wherein the dispense assembly comprises an outlet channel closable by a valve body and a chamber between the container and the valve body, which chamber is at least partly closed by a movable and/or deformable wall part connected to the valve body or a valve seat, such that pressurized beverage from the container filling the chamber forces the movable and/or deformable wall part, into a position biasing the valve body and/or the valve seat in a position closing the outlet channel and by pushing the movable and/or deformable wall part the valve body and/or the valve seat can be forced into a position opening the outlet channel, wherein the outlet channel defines a direction of flow of the beverage towards an outlet end, and wherein the valve body is provided at or near the outlet end of the outlet channel and has a shape with a base facing in a direction against the direction of flow and a tip with an end facing in the direction of flow, wherein the valve body is connected to a valve stem extending through at least part of the outlet channel and is connected to the movable and/or deformable wall closing off part of a chamber, said movable and/or deformable wall forming part of an outward facing surface of the dispensing assembly, wherein during use pressure exerted on the movable and/or deformable wall by a pressurized beverage in said chamber biases the valve body in a position closing the outlet end.

29. Dispense assembly according to claim 28, wherein the valve body is symmetrical.

30. Dispense assembly according to claim 29, wherein the valve body is rotation symmetrical around a longitudinal axis substantially parallel to the direction of flow of the channel near the outlet.

31. Dispense assembly according to claim 30, wherein the longitudinal axis is coinciding with the direction of flow.

32. Dispense assembly according to claim 28, wherein the base is substantially truncated cone shaped or curved, with a top facing upward in the direction of flow, and wherein the end of the tip is rounded off.

33. Dispense assembly according to claim 32, wherein the tip, between the base and the end, has an outwardly curved outer surface, such that beverage engaging the base can be guided from the base over the outer surface to the end forming a beverage jet when leaving the surface at or near said end, and wherein the outer surface is closed and smooth.

34. Dispense assembly according to claim 32, wherein the tip is substantially parabolic in cross section.

35. Dispense assembly according to claim 28, wherein the tip, between the base and the end, has an outwardly curved outer surface, such that beverage engaging the base can be guided from the base over the outer surface to the end forming a beverage jet when leaving the surface at or near said end.

36. Dispensing assembly comprising a container, containing a pressurized beverage, connected to or provided with a dispense assembly, wherein the dispense assembly comprises an outlet channel closable by a valve body and a chamber between the container and the valve body, which chamber is at least partly closed by a movable and/or deformable wall part connected to the valve body or a valve seat, such that pressurized beverage from the container filling the chamber forces the movable and/or deformable wall part, into a position biasing the valve body and/or the valve seat in a position closing the outlet channel and by pushing the movable and/or deformable wall part the valve body and/or the valve seat can be forced into a position opening the outlet channel, wherein the movable and/or deformable wall part is formed by a flexible membrane, wherein the membrane is substantially dome shaped and made of a resilient material.

37. Dispensing assembly comprising a container, containing a pressurized beverage, connected to or provided with a dispense assembly, wherein the dispense assembly comprises an outlet channel closable by a valve body and a chamber between the container and the valve body, which chamber is at least partly closed by a movable and/or deformable wall part connected to the valve body or a valve seat, such that pressurized beverage from the container filling the chamber forces the movable and/or deformable wall part, into a position biasing the valve body and/or the valve seat in a position closing the outlet channel and by pushing the movable and/or deformable wall part the valve body and/or the valve seat can be forced into a position opening the outlet channel, wherein the movable and/or deformable wall part is formed by a substantially dome-shaped flexible membrane made of a resilient material.

38. Dispensing assembly comprising a container, containing a pressurized beverage, connected to or provided with a dispense assembly, wherein the dispense assembly comprises an outlet channel closable by a valve body and a chamber between the container and the valve body, which chamber is at least partly closed by a movable and/or deformable wall part connected to the valve body or a valve seat, such that pressurized beverage from the container filling the chamber forces the movable and/or deformable wall part, into a position biasing the valve body and/or the valve seat in a position closing the outlet channel and by pushing the movable and/or deformable wall part the valve body and/or the valve seat can be forced into a position opening the outlet channel, wherein the movable and/or deformable wall part forms a portion of an outer surface of the dispensing assembly.

* * * * *